United States Patent [19]

Shaler et al.

[11] 4,164,951

[45] Aug. 21, 1979

[54] HAIR CURLER SYSTEM

[76] Inventors: Amos J. Shaler, 705 W. Park Ave., State College, Pa. 16801; Daniel C. McLean, 4029 Alicante, Fort Worth, Tex. 76133

[21] Appl. No.: 739,925

[22] Filed: Nov. 8, 1976

[51] Int. Cl.[2] ..... A45D 2/00

[52] U.S. Cl. ..... 132/31 R

[58] Field of Search ..... 132/31 R, 39, 40, 42, 132/33, 9

[56] References Cited

U.S. PATENT DOCUMENTS

| | | | |
|---|---|---|---|
| 3,175,562 | 3/1965 | Reed | 132/39 |
| 3,316,920 | 5/1967 | Cruise | 132/39 |
| 3,431,917 | 3/1969 | Harris | 132/42 R |
| 3,572,350 | 3/1971 | Adams et al. | 132/39 |
| 3,610,878 | 10/1971 | Thomas | 132/39 |
| 3,614,381 | 10/1971 | Popeil | 132/39 |
| 3,902,508 | 9/1975 | Sliman | 132/40 |
| 4,041,961 | 8/1977 | Shaler et al. | 132/40 |

*Primary Examiner*—G. E. McNeill

*Attorney, Agent, or Firm*—Reising, Ethington, Barnard, Perry & Brooks

[57] ABSTRACT

A hair roller, as disclosed herein, comprises a system of components for drying or curling a hank of hair. The roller comprises a desiccating material and a heat source in an arrangement for regulating heat flow to the hair and for controlling water vapor. Preferably, a tubular body of granular desiccant is employed with a heat storage core within the body. A cover over the body of desiccant provides a desirable outer surface and exhibits properties conducive to efficient water vapor transport and heat transfer. Additionally, a curler cap is provided with properties of thermal insulation and water vapor permeability for enhancing the performance of the roller in curling and drying of the hair.

23 Claims, 19 Drawing Figures

HAIR CURLER SYSTEM

FIELD OF THE INVENTION

This invention relates to hair treating devices of the general type usually referred to as hair rollers or hair curlers. More particularly, the invention relates to hair rollers which are adapted to dry the hair and simultaneously impart a lasting curl to the hair.

BACKGROUND OF THE INVENTION

Hair treating devices, especially for curling hair, are well known in the form of "rollers" which are typically cylindrical mandrels or bobbins of such size that a hank of hair may be wound thereon for shaping and drying purposes. Such rollers have been fabricated in a wide variety of shapes, sizes and materials and have been widely used for both professional and in-the-home hair treatment. Since the advent of such devices, means have been sought for accelerating the drying of wet hair on the rollers and for obtaining a curl having enhanced characteristics of softness and permanence. The acceleration of drying with hair rollers has been accomplished by apparatus which forces heated air over the roller supported hair, usually with the aid of an air circulating bonnet. This forced air bonnet apparatus is known to be undesirably confining and uncomfortable for the user. In the professional hair salon the person receiving the hair treatment is usually seated under a dryer until the desired degree of dryness is achieved. In the home treatment, a portable hair dryer is commonly used which requires a connection to the electrical outlet to energize the portable heater and blower and hence the person is confined to a small area of movement.

There has been much effort by others to provide means for accelerating hair drying on rollers without a forced air bonnet to thereby allow the user complete freedom of movement during the drying period. It has been proposed, for example, to incorporate exothermic materials into hair rollers so that wetting of the material produces a reaction which generates heat and accelerates drying of the hair. Such devices are disclosed, for example, in the U.S. Pat. No. 2,074,816 granted Mar. 23, 1937 to Trotter, and U.S. Pat. No. 2,630,809 granted Mar. 10, 1953 to Lewis et al. Exothermic rollers have not gained significant acceptance, presumably because of the difficulty in controlling the temperature of the device.

Another prior art approach to accelerated hair drying is represented by preheated rollers. Such devices usually are provided with a heat retaining member inside the roller and heat is stored in the member prior to use. The heat may be put into the roller by immersing the same into heated liquid or by so-called dry heat from electrical heaters. A preheated roller for simultaneously drying and curling is disclosed in U.S. Pat. No. 3,705,974 granted Dec. 12, 1972 to Nilsson. Another example of a preheated roller is shown in U.S. Pat. No. 3,485,248 granted Dec. 23, 1969 to Murrey et al. In this patent a cylindrical roller comprises a plastic shell which is filled with a thermoplastic composition as a heat storage medium. It has been proposed also, in the prior art, to add powdered metal for heat storage purposes to pellets of absorbent silicates mixed with clay contained in a hair drying roller. This is disclosed in U.S. Pat. No. 3,656,490 granted Apr. 18, 1972 to Grossman. Such preheated rollers function primarily to drive the water from the hair directly into the surrounding air in the form of water vapor. This process causes drying to proceed at a rate determined largely by the roller temperature and the embient conditions. Consequently, the results achieved are not consistent from time to time, even with a given user. Preheated rollers, known as "hot rollers", have been used extensively in recent years for setting of dry hair. Such rollers are not intended for drying wet hair. An example of a hot roller is disclosed in U.S. Pat. No. 3,541,302 granted Nov. 17, 1970 to Makino.

Th use of desiccant in a hair roller has been proposed for the purpose of accelerating the drying. It is known, for example to construct a roller with a tubular body and fill the central passage of the body with a loose granular desiccant. Such an arrangement is shown in the U.S. Pat. No. 3,431,917 granted to M. F. Harris on Mar. 11, 1969. It is also known in the prior art to provide a spool shaped roller body and fill the annular space between the spool flanges with desiccant, as disclosed in the U.S. patent Reissue No. 27,033 granted Jan. 19, 1971 to H. Mitsumoto. The use of desiccant in powder or particle form poses a problem in containment thereof, and it is believed that this is one reason that such devices have not gained commercial acceptance. Certain of the prior art disclosures of desiccant type rollers describe a desiccant body comprised of powder or particles of desiccant which are somehow held together to form a selfsustaining body. This arrangement is disclosed in the U.S. Pat. No. 2,646,053 granted to M. F. Harris on July 21, 1953 and in U.S. Pat. No. 3,175,562 granted to C. F. Reed on Mar. 30, 1965. Also such a structure is alluded to in the above-cited Mitsumoto patent. Molded desiccant bodies, as heretofore proposed, have not gained acceptance, presumably because the prior art techniques for binding desiccant granules resulted in ineffective or inefficient structures for acceleration of the hair drying process.

SUMMARY OF THE INVENTION

The objective of this invention is to provide a hair roller which dries the hair in less time than heretofore required and which produces consistently a desirably soft and long lasting curl of good finish without hair damage, split ends or "frizz". The hair roller is to be adapted for use with or without the aid of forced hot air and is to be of simple inexpensive structure which is easy to use, noiseless in operation, and adapted to allow the user complete freedom of movement. Further, the roller is to be adapted for repeated usage without deterioration in performance.

According to this invention, the foregoing objectives are achieved by a hair roller which controls moisture removal from the wet hair rolled thereon by means of a desiccating material, together with regulated heat transfer to the wet hair. It has been found that wet hair on a roller is dried most efficaciously by the mechanism of water vapor transport to the substantial exclusion of other mechanisms such as liquid transport by wicking and the like; this invention provides a water vapor transport system with the desired relationship of time, temperature and moisture content to achieve the aforesaid objectives.

The inventive hair roller comprises a system of components which coact to promote water removal by vapor transport. The system comprises a desiccant body and a heat storage core to achieve the desired relationship of temperature, water removal rate and time. The performance of the roller, in respect to curl quality and time is improved by the addition of a cover over the body of desiccant; it can be further improved, if desired, by the use of a roller cap having selected properties.

According to this invention, a hair roller is provided with a self-contained desiccating material and a self-contained heat source in an arrangement for regulating heat flow to the hair and for controlling water vapor. It is preferred to utilize a body of granular desiccant in a tubular array with a heat storage core disposed in the body, the thermal conductivity of the core and body of desiccant being utilized to regulate the flow of heat to the hair. The body of granular desiccant preferably constitutes the main body of the roller and is of hollow cylindrical shape of selected wall thickness with the heat storage core in engagement with the inner surface thereof for good heat transfer to the desiccant.

Further, in connection with the water removal by vapor transport, it has been found that performance is enhanced by a cover over the outer surface of the body of desiccant provided that the cover affords properly correlated properties of thermal conductivity and water vapor permeability. This finding permits the use of a cover, preferably in sheet form, to be disposed around the body of desiccant to provide a desirable texture and decorative appearance for the roller. According to this aspect of this invention, there is provided a cover sheet, preferably of woven fabric, which has either a high thermal conductivity and low water vapor permeability or a low thermal conductivity and a high water vapor permeability.

It has also been found, in accordance with this invention, that the performance of the roller in curling and drying the hair can be further enhanced by means of a curler cap, provided that it has properly correlated properties of thermal insulation and water vapor permeability. According to the invention a curler cap is provided which is fitted over the roller after the tress of wet hair is wound on the roller. Preferably, the curler cap is constructed of an open-cell foam of polymeric material in a semicylindrical shape. The preferred construction comprises a double layer of a polyether foam with the inner layer being more permeable to water vapor than the outer layer. Further, the inner layer may advantageously be of hydrophobic material and the outer layer of hydrophilic material.

The subject invention enables a quasi or partial permanent wave to be imparted to the hair without the use of chemicals, as are commonly used in modern day practice of giving permanents, and without the use of high temperatures, as in the older practice of giving permanents. This partial permanent wave is achieved by the combination of the heat storage core and the body of desiccant which coact to provide sufficiently high temperature and moisture control so that hydrogen linkages in the hair (although not the stronger sulfide linkages) are broken and reformed without damage. The chemical permanent waving process breaks and reforms the sulfide linkages. The reformed hydrogen bonding is, however, sufficiently strong to provide a curl or wave which will last several days; this degree of permanency, taken with the ease and the short time required for use of the inventive rollers, meets a long felt need for hair drying and curling in the home as well as in professional salons.

Also, in accordance with the subject invention, dry hair can be curled by wetting the surface of the roller just after regeneration and before winding the tress thereon.

DETAILED DESCRIPTION OF THE INVENTION

A more complete understanding of the invention may be obtained from the detailed description that follows, taken with the accompanying drawings in which.

Figure 1:
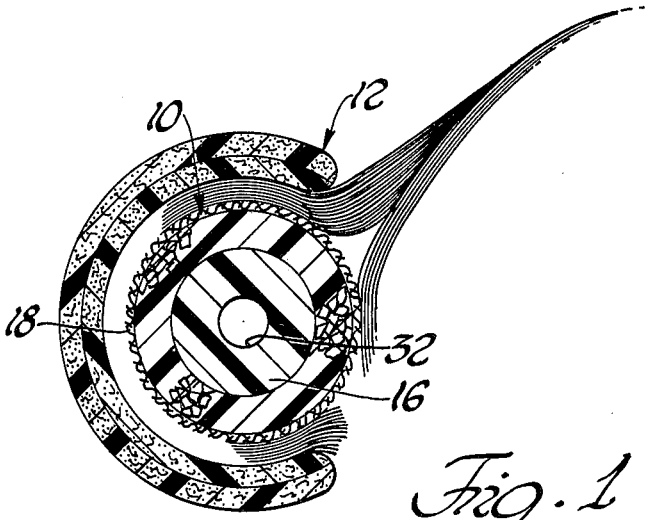
FIG. 1 shows the hair roller of the subject invention together with a roller cap.

Referring now to the drawings, there is shown an illustrative embodiment of the invention in a hair roller for accelerated drying and curling of the hair. In FIG. 1, a hair roller 10, according to the invention, is illustrated as being applied to a hank of hair on a person's head. A roller cap 12, also according to the invention, is applied over the hair on the roller. As is well known, it is common practice for people, especially women, to wash their hair at frequent intervals and undertake to obtain curled tresses while the hair is drying by "putting up" the hair on rollers. The roller 10, and if desired, the roller cap 12, of this invention are adapted for use in the practice just mentioned. It will be understood, as the description proceeds, that the hair roller 10 may be used alone or it may be used in combination with the roller cap 12. The description of the roller cap will be deferred until after the roller has been described.

As shown in FIG. 1, the roller 10 comprises a tubular body 14 of desiccant and a heat storage core 16 which is disposed within the body 14 and in engagement with the inner surface thereof to provide good heat transfer therebetween. The roller 10 is provided with a cover 18 which may be used with great advantage although it is not an essential component of the hair roller.

The components of the hair roller system will now be described in detail, along with the relationship of each component to the others. The components to be described are (1) the desiccant body (2) the heat storage core (3) the roller cover and (4) the roller cap.

The Desiccant Body

The desiccant body, as used in this invention, comprises a mass of granules of a desiccant, preferably silica gel. Other desiccants including activated alumina and activated carbon and mixtures of silica gel and activated carbon are also suitable. The desiccant body is in tubular form with the granules of desiccant being held together in the shaped form either by a shaped envelope for loose granules or by bonding of the granules in a self-sustaining body.

Figure 2:
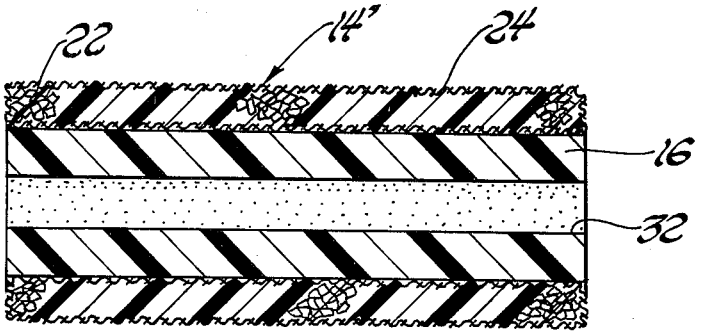
FIG. 2 is a cross-sectional view of one embodiment of the invention.
Figure 3:
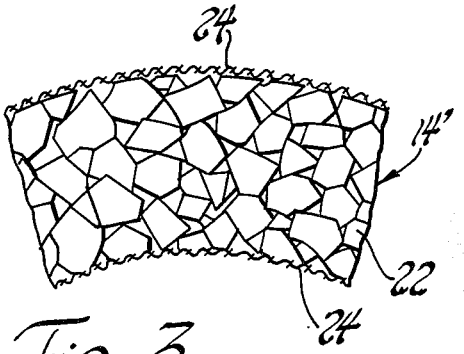
FIG. 3 is a fragmentary view of a portion of FIG. 2.

A desiccant body 14' of loose granules of desiccant is shown in FIGS. 2 and 3. The desiccant body comprises the mass of desiccant granules 22 contained within an envelope 24. The granules are preferably silica gel in the size range from 8 mesh to 60 mesh. A preferred silica gel is Davison silica gel grade 408 available from the Davison Chemical Division of W. R. Grace Company of Baltimore, Md. The envelope 24 is an elongated annular container, i.e. it comprises inner and outer sleeves which are joined to each other at adjacent ends. The envelope is constructed of an open mesh material having a mesh size small enough to contain the small granules of desiccant. The granules are preferably in the size range from 12 mesh to 28 mesh and the material of the envelope should have mesh size of no larger than 30 mesh. The envelope 24 is suitably a woven fabric; preferably it is made of a nonhygroscopic fiber, for example, nylon, provided that the envelope affords the same properly correlated properties of thermal conductivity and water vapor permeability as has previously been mentioned in reference to a cover over the outer surface of the body of desiccant.

The desiccant body 14' comprised of the envelope 24 filled with the loose granules 22 will be nonrigid but will sustain an approximate tubular shape under its own weight. The desiccant body 14' is of such size relative to the core 16 that the internal diameter thereof will form a snug fit over the core. This dimensional relationship provides for physical engagement of the desiccant body with the core so that heat may be transferred conductively by direct contact between the core and the desiccant granules or through the intermediary of the envelope material. For that reason, it is desirable that such a cover envelope material also have high thermal conductivity. Additionally, the snug fit of the core in the desiccant body causes the desiccant body to assume and maintain a firm tubular shape. The desiccant body 14' may be fabricated in a wide range of sizes. For example, the length of a roller may range from $1\frac{1}{2}$ inches to $3\frac{1}{2}$ inches with an outside diameter ranging from $\frac{1}{2}$ inch up to 4 inches. The wall thickness of the desiccant body should be at least $\frac{1}{4}$ inch thick to obtain the best performance but additional thickness is not useful regardless of the other dimensions of the body.

Figure 4:
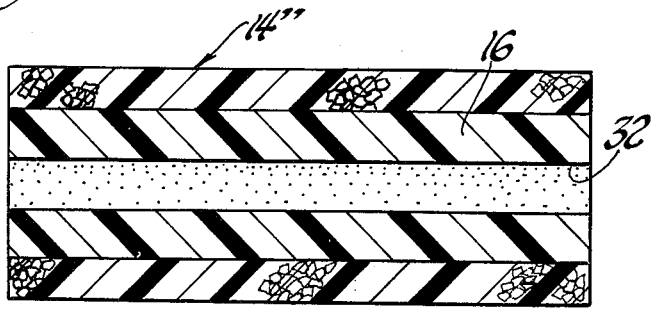
FIG. 4 is a cross-sectional view of another embodiment of the invention.
Figure 5:
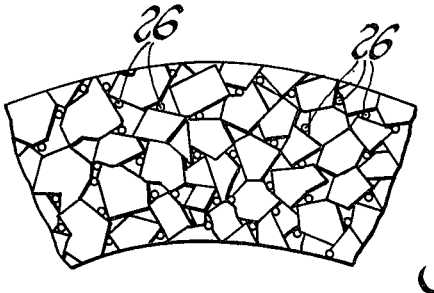
FIG. 5 is a fragmentary view of a portion of the device in FIG. 4.

Referring now to FIGS. 4 and 5, there is shown a self-sustaining desiccant body 14" which is comprised of a mass of bonded granules of desiccant. Such a desiccant body is fully disclosed in our copending patent application, Ser. No. 646,549 filed Feb. 9, 1976 and incorporated herein by reference. The desiccant body 14" is a sintered composite body which comprises a mixture of granules of desiccant and particles of binder. The body 14" is formed of the mixed granules and particles into a tubular shape and then sintered to perform the bonding. An enlarged fragmentary view of the internal structure is shown in FIG. 5. The body comprises a mass of granules 22" of a desiccant, such as silica gel, and the granules are held together by particles 26 of binder, such as a nylon, between contiguous granules of desiccant. Each granule 22" is of irregular shape and the granules are assembled to form the desired overall tubular shape by means of a retaining form or mold. The granules are preferably assembled loosely, i.e. the only compaction force being the weight of the granules, so that the granules form an array with discrete points of engagement between contiguous granules. This leaves voids or interstices 16 separating the granules throughout the array. Such interstices open into each other so that there is communication between the adjacent interstices and communication between any two interstices in the body. In this respect, the granules in the sintered body 14" are substantially the same as the granules in the body 14' of loose desiccant granules. Each of the particles 26 of the binder is attached to discrete surface areas of contiguous granules with some of the particles 26 bridging between the granules.

In the preferred embodiment of the sintered body 14" the desiccant granules are silica gel and the binder is of nylon powder. Other desiccants including activated alumina are also suitable; other thermoplastic binders, also of organic polymeric material which may be used in powder or particulate form are those like polycarbonate and polyvinylchloride that have a melting point above approximately 260° F. The desiccant is comprised of granules in the size range from 8 mesh to 60 mesh. A preferred granule size for a given body in a hair roller is comprised of granules in the size range from 12 mesh to 28 mesh. The binder powder of organic polymeric material is preferably of a particle size of 200 mesh or smaller. In the preferred embodiment the aforementioned size ranges for desiccant granules and binder particles result in typical desiccant granule having a diametral dimension on the order of 1000 microns whereas a typical binder particle would have a diametral dimension on the order of 100 microns. A preferred silica gel is the same as that described with reference to the desiccant body 14" above. A preferred nylon powder is Nylon 11 which is available from the E. I. Dupont De Nemours Company. The preferred sinter formulation is that which provides complete bonding of the desiccant granules with the smallest amount of binder so that the maximum sinter porosity and the lowest bulk density are attained. The preferred ratio of ingredients is five parts by weight of gel to one part by weight of nylon powder. Preferably, a quantity of water, from 3 to 10% by weight, is added to the mixture to aid distribution of the binder particles onto the surface of the granules prior to forming of the body.

The desiccant body 14" may be fabricated in the same range of sizes as described above with reference to the desiccant body 14'. As shown in FIG. 4, the internal surface of the desiccant body 14' is in intimate engagement with the outer surface of the core 16. This structural relationship is preferably obtained by utilizing the core 16 as a mold member during the sintering of the body 14". By this technique of molding the body 14" with the core 16 in situ, a bond can be obtained between the binder particles of the body and the surface of the core. This intimate engagement of the core with the desiccant body 14" provides for conductive heat transfer between the core and the desiccant body.

Heat Storage Core

The heat storage core 16, as shown in FIG. 1 and also FIGS. 2 and 4 as mentioned above, is adapted to accept heat from an external source and to transfer such heat to the desiccant body at a predetermined rate. The core 16 is preferably constructed of a material having a high specific heat and a relatively low specific gravity, such as Nylon 11 which is the preferred material. The objective is to provide the maximum heat retention with the smallest weight. The core has a bulk density greater, preferably by a factor of about 2 or more, than that of the desiccant body and has a total mass about equal to that of the body. The core 16 includes a bore 32 adapted to receive a heating element (not shown) in the form of a pin which fits within the bore. Alternatively, the core 16 may be solid and the roller may be heated in a conventional or a special oven. The core 16 has the same cross-sectional configuration as that of the internal surface of the desiccant body, preferably cylindrical. At the interface the desiccant body and the core are in intimate engagement as described above to provide heat transfer from the core to the body. The core may be made of other materials, including other thermoplastics such as polycarbonate. It should, however, have a specific heat in the range of about 0.5 to 0.6 calories per gram. It should also have a softening temperature which is higher than the temperatures to which it will be subjected during heating of the hair roller and not substantially lower than the temperature to which it will be subjected during fabrication, as in the case of sintering the desiccant body with the core in situ. With the preferred materials described above, the softening point should be in excess of 300° F.

Roller Cover

Hair rollers of the structure thus far described, namely a desiccant body and a heat storage core, are entirely functional and, as discussed below, produce highly satisfactory results. However, the desiccant body has an undesirable surface texture for receiving the hair and is also somewhat unsightly. Accordingly, it is desirable to provide a cover over the outer surface of the desiccant body to provide a suitable hair receiving surface with an attractive finish. Research on many different cover materials revealed that the performance of the roller is significantly degraded by the addition of a cover unless the cover material exhibits a special relationship of properties. It has been found that a roller cover which exhibits the desired relationship of properties will actually enhance the performance of the roller. The significant properties of the cover material have been found to be the thermal conductivity and the permeability to water vapor. Further, the hydrophilic and hydrophobic character of the material is a factor to be considered. The desired properties of the cover material will be described more fully below.

Figure 6:
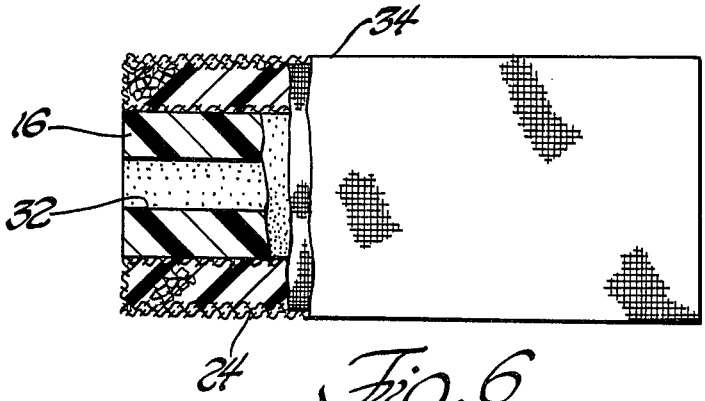
FIG. 6 is a view of the embodiment of FIG. 2 provided with a roller cover.
Figure 7:
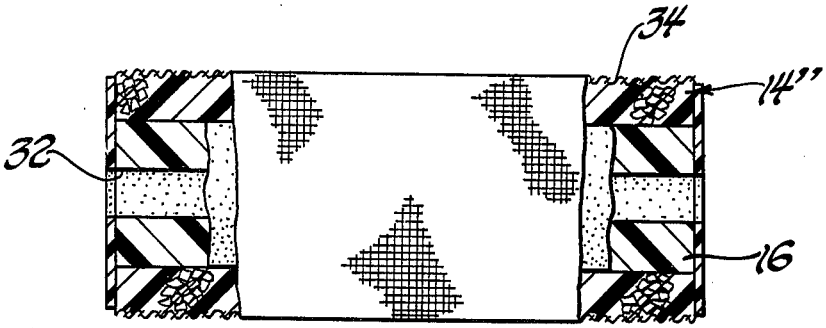
FIG. 7 is a view of the embodiment of FIG. 4 provided with a roller cover.
Figure 8:
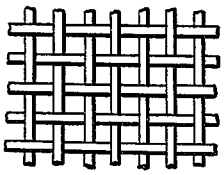
FIG. 8 is a fragmentary view of the cover material.

As shown in FIGS. 6 and 7, each of the respective hair rollers is provided with a cover 34. The cover 34 comprises a sheet-like material of woven fabric and is stretched over the surface of the desiccant body. The cover is suitably made from a rectangular sheet wrapped around the body with the edges joined at a seam by an adhesive but other methods may be used, such as tubular sheet. A fragmentary, magnified view of the cover 34 is shown in FIG. 8. This represents a preferred cover material which is a fabric of woven nylon, specifically, a fabric of plain weave gabardine nylon with a 50-filament yarn of 70 denier, a warp 35 of 140 mesh and a weft 36 of 66 mesh. Such a fabric is manufactured by Tapetex Products, Inc. of Rochester, New York. This fabric has a thermal conductivity of 1.8 BTU-in/ft$^2$ hr°F. and a water vapor permeability of 1.5 darcies, both at 260° F. It is a hydrophobic material. Another cover material which exhibits the desired properties is a coarse woven fibrous silica cloth sold under the name of "REFRASIL", type number C100-20 by the Hitco Company of Gardenia, Calif. This material is a fabric of plain weave with a 4000-filament yarn of 0.00036-inch filaments; a warp of 15 mesh and a weft of 14 mesh. This material is classified as hydrophobic material. A roller cover of either one of the aforementioned materials or of other hydrophobic materials of like properties is effective to enhance the performance of the hair roller relative to the hair roller without any cover. It is noted that the cover material must exhibit the combination of high thermal conductivity and low water vapor permeability or low thermal conductivity and high water vapor permeability. The cover material should have a thermal conductivity at least of 1.5 BTU-in/ft$^2$ hr°F. at 260° F. if the water vapor permeability is less than 2 darcies at that temperature. Alternatively, the cover material should exhibit a water vapor permeability of at least as great as 7 darcies at 260° F. with a thermal conductivity less than 0.5BTU-in/ft$^2$ hr°F. The performance of the hair roller as it is affected by the roller cover and the selected materials therefor will be discussed further below in connection with the operation of the hair roller.

Roller Cap

It has been found, in accordance with this invention, that the drying of hair on the roller may be substantially accelerated by the roller cap 12 which was referred to in FIG. 1. The roller cap is adapted to provide thermal insulation to reduce the rate of heat loss from the roller to the atmosphere and yet to permit water vapor to pass from the roller and the hair to the atmosphere.

Figure 9:
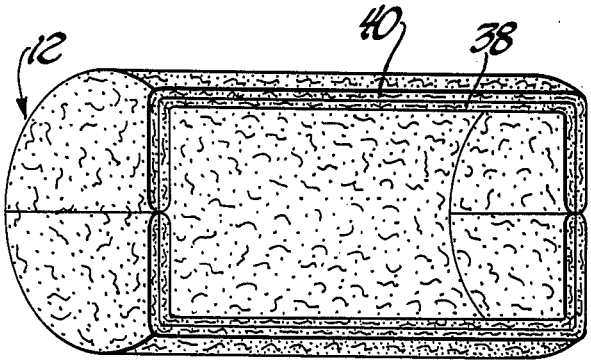
FIG. 9 is a perspective view of the roller cap.
Figure 10:
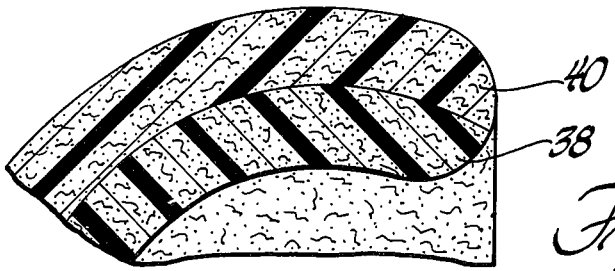
FIG. 10 is a fragmentary view of the cap of FIG. 9.

A roller cap 12 is shown in detail in FIGS. 9 and 10. The roller cap comprises a semi-tubular member which is formed of a stretchable porous material of good thermal insulating properties, preferably a porous polymeric foam. The cap is formed from sheet material into a shape of C-shape cross-section and provided with end walls. The cap is of such size that it can be readily stretched over the wound tress of hair on the roller, and will then shrink of its own elasticity to fit snugly over the tress on the roller, as shown in FIG. 1. Preferably, the cap material is of double-layer construction with the inner layer 38 and outer layer 40 both being made of polyester open-cell foam, preferably polyurethane. The inner layer 38 is preferably hydrophobic and the outer layer 40 is preferably hydrophilic with the inner layer being more highly porous or of larger cell structure. The inner layer is also preferably thicker, for example, with 3/16 inch thickness with an outer layer of ⅛ inch thickness. The layers are suitably secured to each other around the peripheral edges by heat bonding or adhesive material.

The effect of the roller cap on the performance of the roller will be discussed below in connection with the operation of the roller.

Operation of the Hair Roller

In use of the hair roller just described, the roller is regenerated, prior to each application to the hair. The roller, along with others of various sizes in a set of such rollers, may be heated in a conventional heater for hair rollers. Such apparatus is preferably of the type which is provided with heating pins adapted to mate with the bores of the rollers, although a conventional oven heater may also be used. The rollers are heated to a temperature above the boiling point of water, such as about 260° F., preferably in turbulently flowing air. At this temperature, and in turbulently flowing air, the desiccant body is dehydrated, i.e. the water adsorbed during a previous application of the roller or adsorbed from the atmosphere during the interval since the previous application, is driven off so that practically no water remains in the desiccant. Also, the temperature of the core 20 is increased to the same temperature and thus serves to store heat to use in the treatment of the hair. Heating of the rollers to the desired temperature, together with their dehydration, may require a period of time ranging from 5 minutes to 45 minutes depending upon the heating capacity and air turbulence of the apparatus used and the amount of water previously adsorbed. After the desired regeneration has been achieved, the heated roller is ready for application to the hair.

As soon as the roller has been removed from the regeneration apparatus a very steep temperature gradient develops near the outer surface across the radial dimension of the desiccant body. This obtains because the desiccant body is a poor thermal conductor due to the low density of the granules and the low bulk density of the body coupled with the fact that it has a discontinuous or porous surface. Within a few seconds after extraction from the regeneration apparatus the roller can be handled by bare fingers without discomfort even though all but the surface is at a temperature in excess of the boiling point of water. The sintered body thus acts as an insulator and impedes heat transfer from the core so that heat flow therefrom is regulated. Typically, the roller will be applied to wet hair of the user where the desired treatment is drying and curling of the hair. When the roller is first applied to the hair water vapor will be produced at a rapid rate. The region immediately surrounding the roller and the tress of hair thereon is permeated by the water vapor generated from the wet hair by the heat released from the roller. This water vapor is preferentially taken up by the desiccant and is also dispersed into the surrounding atmosphere, or through the cap and thence to the atmosphere, at a rate dependent upon air movement, temperature and humidity.

The quantity of water vapor taken up by the desiccant body is, to a large extent, independent of the conditions of the surrounding atmosphere and is dependent primarily upon the available surface area of the desiccant material and the temperature of the desiccant material and the prior moisture content thereof. Stated otherwise, the desiccant will adsorb water vapor provided that the ratio of partial pressure of the vapor in the air to the saturation value (i.e., the relative humidity) is greater than the same ratio (i.e. fugacity) in the desiccant. The rate of adsorption increases with the difference between relative humidity of the air and fugacity of water in the desiccant. Both of these decrease with temperature but the relative humidity decreases faster with increasing temperature than does the fugacity of water in the desiccant. Accordingly, the desiccant body of the roller is conditioned to take on a large quantity of water vapor at a relatively high rate by reason of the initial high temperature and low water content thereof and the initial high water content of the air surrounding the hair. The temperature of the desiccant body is maintained at an elevated level by the transfer of heat from the heat storage core 20 over a period from about ten minutes to about one half-hour. At a later time, the hair having become drier and the core and desiccant being cooler, the rate of adsorption of water vapor by the desiccant decreases and eventually becomes negative, vapor then passing out of the desiccant, through the air spaces between the hair and out to the atmosphere, or through the cap to the atmosphere. Since the granules of desiccant are separated by interstitial spaces which open into each other, the water vapor is allowed to reach granules throughout the desiccant body. The granules in the region near the core remain very hot for a period up to thirty minutes and initially exhibit a slightly lower capacity for taking up water vapor whereas those near the outer surface, being initially cooler, do the bulk of the adsorbing. Hence, the upper limit of the useful thickness of the desiccant body. It is noted that the heat of adsorption which is incident to the adsorption process is negligible in comparison with the quantity of heat supplied by the heat storage core.

Figure 11:
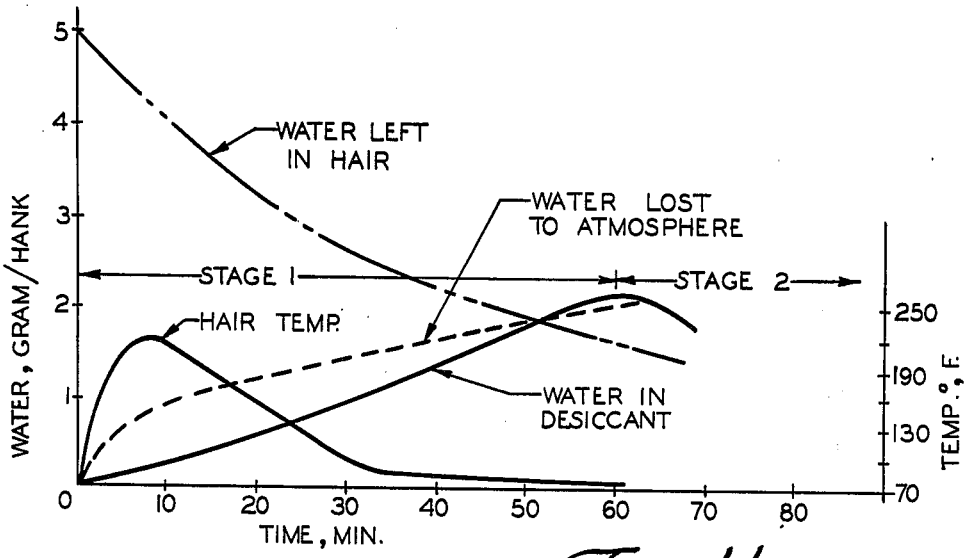
FIG. 11 is a graphical representation of vapor transport in the rollers.

The operation of the hair roller of this invention will be further described on the basis of a hypothesis of water vapor transport produced by the hair roller as a function of time. In the explanation that follows, typical performance characteristics will be presented; it is understood, of course, that different results will be obtained with different qualities of hair. FIG. 11 is a graphical representation of the water vapor transport produced by the hair roller of this invention as comprised of the desiccant body and the heat storage core, i.e. without the roller cover and without the roller cap. The hair drying and curling process occurs in two stages which are depicted as stage 1 and stage 2 in FIG. 11. For the example represented by FIG. 11, the tress or hank of hair (of a standard quantity and quality) is wetted with a standard quantity of water. In this example the hair is wound directly upon the surface of the desiccant body and is retained in place without a roller cover and is thus exposed directly to the atmosphere. The temperature of the hair increases rapidly as shown in FIG. 11 and reaches a maximum value in a period of about ten minutes, then as the heat in the core is dissipated the hair temperature declines somewhat gradually over the next forty or fifty minutes until the hair has reached the atmospheric temperature. In stage 1 the hot roller heats the hair sufficiently to cause a rapid rate of evaporation and the water vapor is adsorbed at a rapid rate by the desiccant and, at the same time, water vapor is lost at an increasingly rapid rate to the atmosphere. At a point between stage 1 and stage 2 the quantity of water in the desiccant reaches a peak value and then begins to decrease; at this peak value equilibrium is reached between the rate of water vapor flowing into the desiccant from the hair and the rate of water vapor being evaporated out of the desiccant back into the air spaces between the hairs. At this time water vapor is moving rapidly out of the hair into the atmosphere. The hair temperature is then diminished to a relatively low value, due largely to the gradual exhaustion of heat flowing from the heat storage core and the increased rate of heat loss from the hair. Thus the water left in the hair diminishes at a lower rate and is taken up by the atmosphere along with water vapor flowing outwardly from the desiccant body. This continues through the second stage until the hair reaches a desired degree of dryness and set or curl which is typically achieved after about 15 to 40 minutes, depending upon the characteristics of the particular hair. The foregoing example is given primarily for explanation of the process involved in the use of the hair roller of this invention and not for the purpose of specifying the performance in absolute terms which can be achieved with the subject hair roller. In the description that follows, relative performance of the hair roller including a roller cover and including a roller cap will be given.

At this point it will be helpful to consider certain figures of merit in the performance of the hair roller. In evaluating a roller for performance, a standard hank of hair (from a standard wig) is wetted with a predetermined quantity of water. The roller is properly regenerated and applied to the hank of hair. The weight of water gained by the roller (desiccant body) during the drying time is determined and a judgment is made of hair dryness and of curl quality. Dryness is rated on a scale of 1 to 4 where 1 is dry and 4 is damp throughout, with dryness rating less than 2 being satisfactory. Curl quality is rated on a scale from 1 to 4 with 1 being a hard curl, 2 a soft curl, 3 a weak curl, and 4 no curl at all. It was discovered that dryness and curl quality are correlated in such a manner that the curl quality number is proportional to the dryness number with a constant of proportionality that varies with drying time. Because of this relation a composite number is used for judging the result, the composite number being equal to the average value of the dryness number and the curl quality number. The composite number is called the "result index". A result index of two or less is satisfactory. A result index of 1.3 or less results from a frizzy, hard curl. A result index of b 2.5 or greater results from a curl which is too weak to be desirable. Another meaningful factor is termed the "water ratio" which is determined from the measurement of water gained by the desiccant body. The water ratio is the ratio of the weight of water in the desiccant body to the weight of water initially applied to the hair. In general the more water applied to the hair, the more will end up in the desiccant body; however, this ratio will vary with different roller covers. There is correlation of water ratio with the result index: if the roller cover has properties which yield better performance than no cover, the lower the water ratio the better the result index; if the cover has properties which result in worse performance than no cover then the lower water ratio is accompanied by a worse result index.

Figure 12:
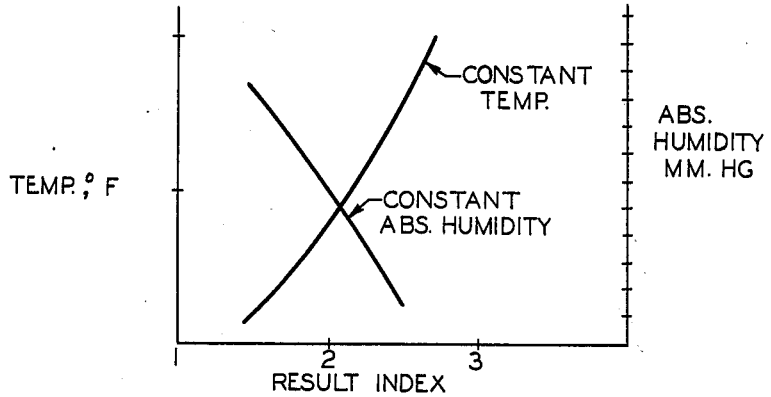
FIGS. 12 and 13 are graphical representations of the performance of the subject invention.
Figure 13:
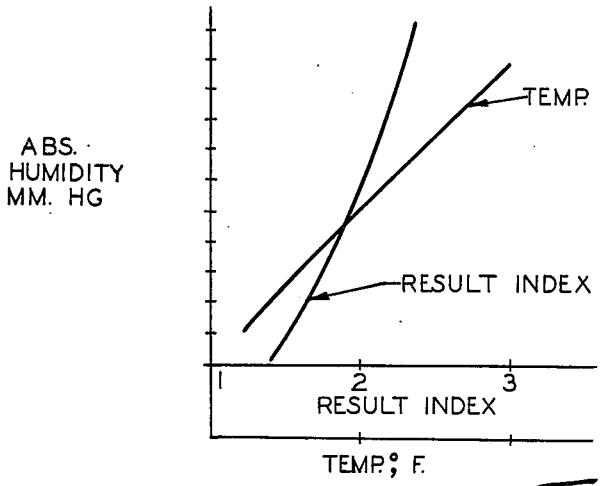

Extensive testing shows that less than half the water removed from the hair is left in the desiccant body; it follows that a significant action of the hair roller system is the promotion of evaporation of water into the atmosphere. Since the ambient temperature and humidity conditions will vary, the effect of these conditions must be considered in evaluating roller performance. There is a definite correlation between the result index and ambient temperature, ambient absolute humidity and air turbulence around the roller. FIG. 12 is a graphical representation of the result index variation with temperature and humidity. It is noted that if the temperature is held constant, the result index increases rapidly with an increase in absolute humidity. It is also noted that if absolute humidity is held constant, the result index decreases rapidly with an increase in temperature. Fortunately, in practice, the value of ambient temperature and absolute humidity generally increase and decrease together so that the effect of one variation is moderated by the other. This relationship is shown in FIG. 13 wherein the condition of increasing humidity with increasing temperature is represented. The result index increases slowly with increasing temperature and then as temperature increases further the result index begins to decrease. This relationship indicates that the roller operates substantially independently of ambient temperature and humidity even though a significant amount of water removal is discharged into the atmosphere.

It will be understood from the discussion above with reference to FIG. 11 that during the drying and curling process, there is a continuous flow of water vapor into or out of the desiccant body. At the same time there is a continuous flow of heat from the heat storage core through the desiccant body to the hair. This vapor flow and the heat exchange are affected by the interface between the desiccant body and the hair. In the example represented by FIG. 11, the hair was wound on the bare desiccant body, i.e. there was no roller cover at the interface. As discussed previously, the presence of a roller cover forming the interface materially affects the performance of the roller.

Figure 14:
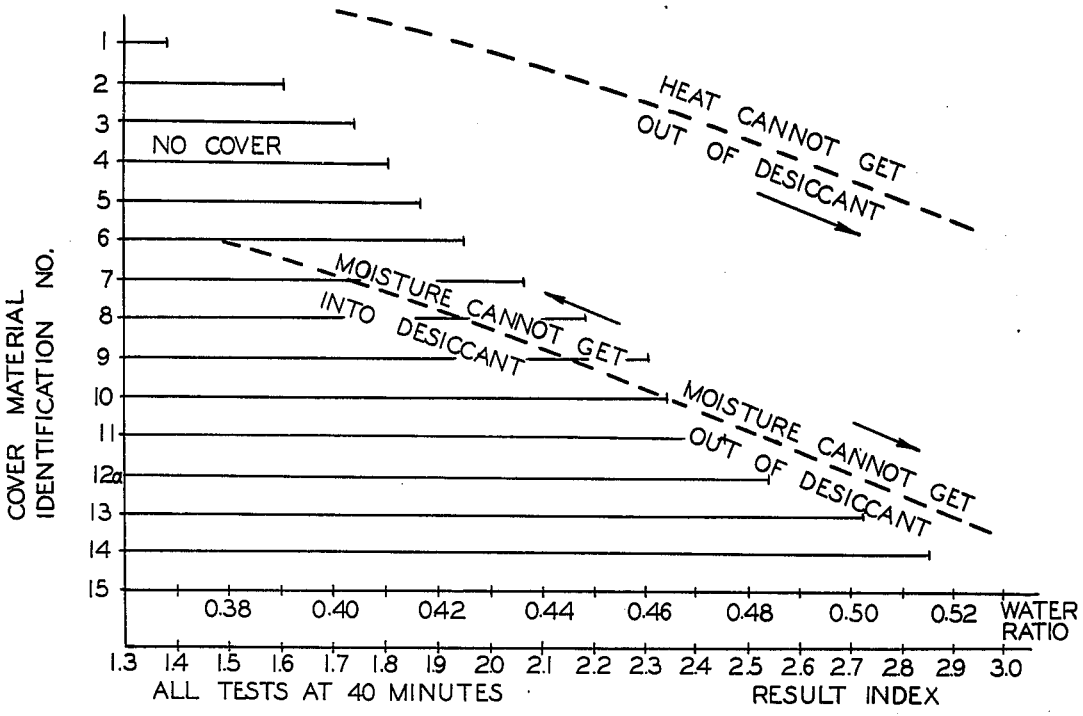
FIG. 14 is a chart pertaining to cover materials.

The effect of roller cover properties on performance is illustrated in the chart of FIG. 14. In this chart the effects of roller cover properties on the result index and the water ratio are shown for a wide range of roller cover properties. It is noted that the various cover materials are identified by number along the ordinate axis and the result index and the water ratio are plotted on the abscissa axis. It is noted that the cover materials are numbered in the order of the result index so that the lower the number the better the performance. Attention is directed to identification number 4 which represents no roller cover, i.e. the hair being wound directly upon the bare desiccant body. Thus, it is seen that of the materials represented, only numbers 1, 2 and 3 are better in performance than no cover at all. Cover material number 1 is a gabardine nylon described previously which has a high thermal conductivity and a low water vapor permeability. Cover material number 2 is the "REFRASIL" fabric described previously which has a low thermal conductivity and a high water vapor permeability. Cover material number 3 is a nylon material which has a high thermal conductivity and a low water vapor permeability but the latter is higher than in cover material number 1. For the remaining materials represented, those having a result index above the value or identification number 4 do not perform well because the thermal conductivity and water vapor permeability are not as well matched. With some, the thermal conductivity is too low and hence heat does not get out of the desiccant fast enough to raise the temperature of the hair to the desired level in stage 1. These are represented by the materials yielding a high water ratio and a high result index. With some others, the water vapor permeability is too low and moisture cannot get into the desiccant fast enough during stage 1, although the thermal conductivity is otherwise satisfactory. These are represented by those cover materials which yield a low water ratio. With still others, the thermal conductivity is too high or the water vapor permeability is too low so that moisture cannot get out of the desiccant in stage 2. These, like the first, are represented by materials yielding a high water ratio and a high result index. For those cover materials having a low water vapor permeability, the performance is poor because moisture cannot get into the desiccant.

Figure 15:
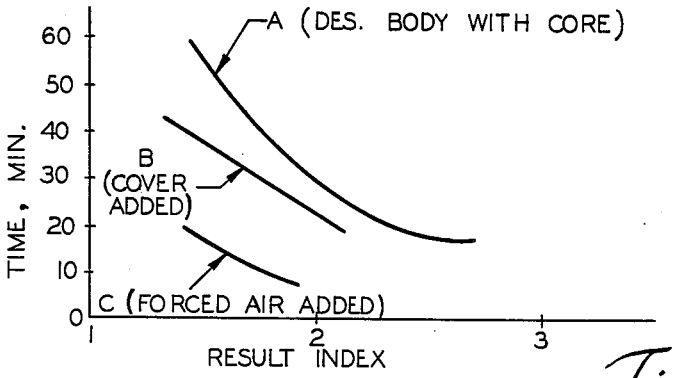
FIGS. 15 and 16 are graphical representations of performance.
Figure 16:
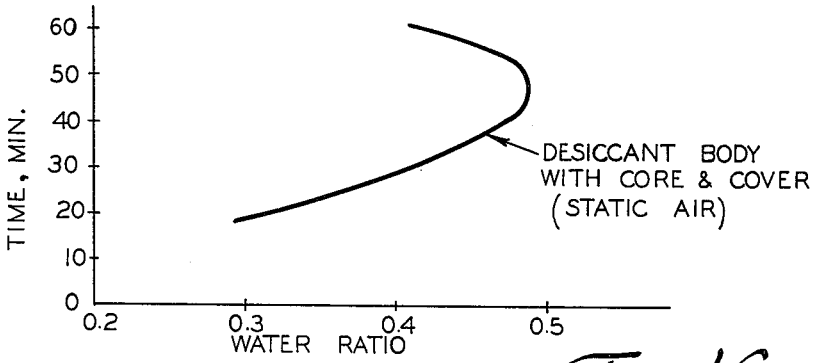

The performance, in terms of drying time and result index for the rollers of this invention is depicted in FIG. 15. As shown in this FIGURE, curve A represents a desiccant body with a heat storage core and roller cap (but without a roller cover). This combination produces a curl having a result index of 2.0 in a time period of slightly over 30 minutes with a particular type of hair. The result index will improve with added time and reach a value of about 1.3 after 60 minutes. The curve B represents the performance of the roller with a roller cover added thereto. It is noted that the drying time is materially decreased so that a result index of 2 is achieved in about 25 minutes. As mentioned above, air movement around the roller makes a significant difference since a large portion of the water from the hair is discharged to the atmosphere. The curve C in FIG. 15 represents the performance of the roller with a cover when forced warm air from a hair dryer is applied around the roller. This decreases the drying time very significantly so that a result index of 2 may be achieved in less than 10 minutes. Results intermediate those of curves B and C are obtained if the person wearing the covered rollers and cap stands near a fan or is outdoors in a breeze during the drying period. As shown in FIG. 16, the water ratio first increases with drying time and then decreases, as discussed with reference to FIG. 11. This curve of FIG. 16 shows a maximum value of water ratio, occurring after approximately 45 minutes of drying time.

Figure 17:
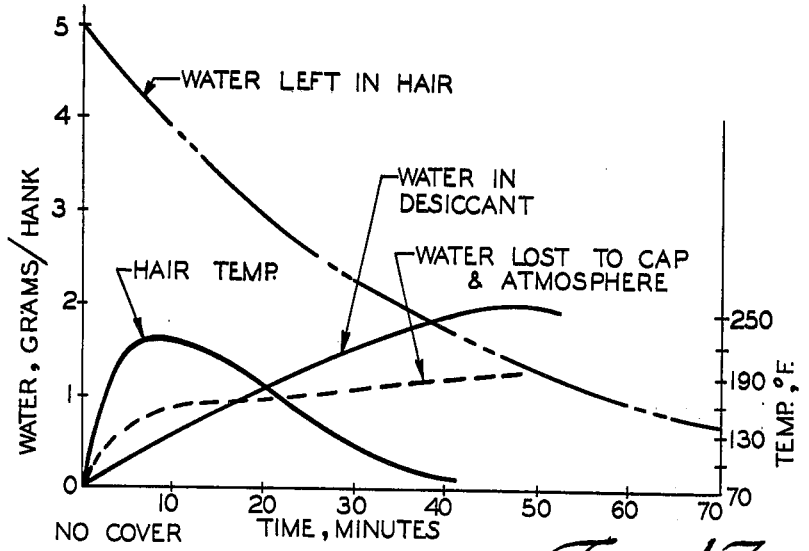
FIGS. 17, 18 and 19 are graphical representations of vapor transport as affected by the roller cover.
Figure 18:
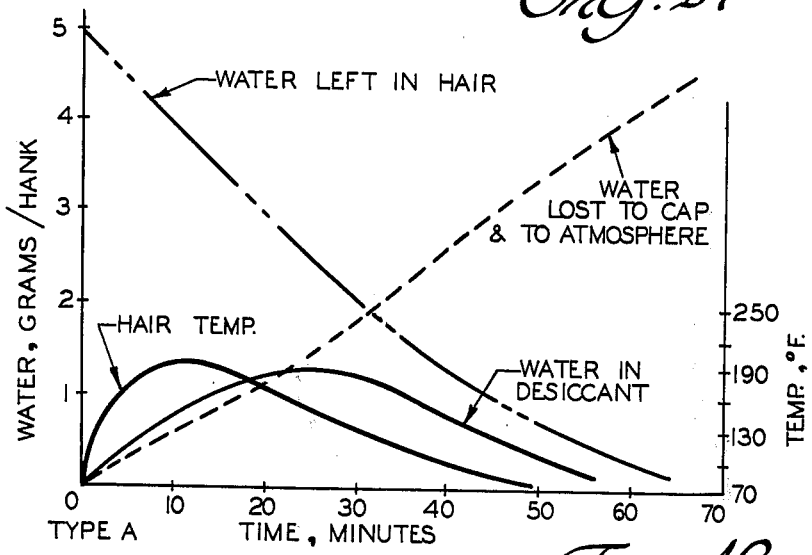
Figure 19:
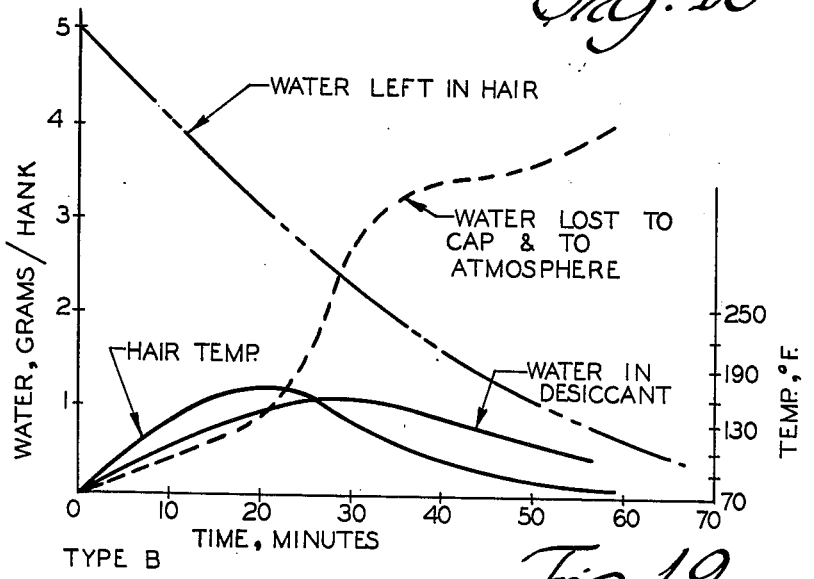

FIGS. 17, 18 and 19 depict the vapor transport within the roller system as a function of time and also the hair temperature as a function of time. FIG. 17 represents a roller with no cover and FIGS. 18 and 19 represent rollers with the two different types of high performance covers. These sets of curves are to be compared with the curves of FIG. 11 which represent a roller with no cover and no roller cap.

FIG. 17, representing a roller with a roller cap but no cover, shows that the hair temperature increases rapidly and the water in the desiccant likewise increases rapidly so that the equilibrium point is reached at about 25 minutes. Due to the use of the roller cap the temperature of the hair will remain at a relatively high value during the drying period and the desired degree of dryness will be reached in about 40 minutes. FIG. 18 represents a roller with a type A cover which is of a material having low heat conductivity and high water vapor permeability. Because of the low heat conductivity the hair temperature will increase slowly so that the equilibrium point is not reached until about 50 minutes. However, the high permeability of the cover material permits water vapor to rapidly enter and leave the desiccant body and the water lost to the roller cap and atmosphere occurs at an increased rate. Accordingly, the desired dryness is still achieved in a period of about 40 minutes. FIG. 19 represents a hair roller with a type B cover which is of a material having a high heat conductivity and a low water vapor permeability. Because of the high heat conductivity the hair temperature will rise rapidly and the water in the desiccant body will also increase rapidly. The equilibrium point will be reached in about 35 minutes. The water lost to the roller cap and the atmosphere recedes at a moderate rate. However, the desired degree of dryness is achieved in a period of about 35 to 40 minutes.

An Additional Mode of Use

The hair roller of this invention is also adapted for use in curling dry hair. For this purpose the surface of the roller is wetted with water, suitably by misting, just after regeneration and before a dry tress is wound thereon. Preferably the thermal and water vapor permeability properties of the roller, with or without cover and with or without cap, are the same as those which, as described above with respect to wet hair, would cause a tress of wet hair to be satisfactorily dried and curled only after phase 2 has been reached. Phase 1 then merely heats the hair, and the moisture then added to the desiccant body at the start of phase 2 then stays in the desiccant body until phase 2 is well under way in the thermal sense, and then moisture leaves the roller, enters the interstices in the tress, dampening the hair until the hydrogen bonds are weakened, and then finally, as before, leaves the hair and enters the atmosphere. The hydrogen bonds reform and the curl becomes semi-permanent, as in the case of the drying and curling of initially wet hair.

Although the description of this invention has been given with reference to a particular embodiment, it is not to be construed in a limiting sense. Many variations and modifications will now occur to those skilled in the art. For a definition of the invention reference is made to the appended claims.

The embodiments of the present invention in which an exclusive property or privilege is claimed are defined as follows:

1. A hair treating device adapted to receive a hank of hair, said device comprising a tubular body of desiccant and a heat storage core disposed within the tubular body, said heat storage core having a bulk density greater than that of the tubular body.

2. The invention as defined in claim 1 wherein the heat storage core is in engagement with the inner wall of the tubular body to facilitate heat transfer therebetween.

3. The invention as defined in claim 2 wherein said core is a solid material.

4. The invention as defined in claim 3 wherein said core defines an axially extending passage adapted to receive a heater element.

5. The invention as defined in claim 1 wherein said core has a specific heat in excess of 0.5 calories per gram.

6. The invention as defined in claim 1 wherein said core is a body of nylon.

7. The invention as defined in claim 1 wherein said tubular body is comprised of loose granules of desiccant within a mesh container.

8. The invention as defined in claim 1 wherein said tubular body comprises a self-sustaining body of bonded granules of desiccant.

9. The invention as defined in claim 7 wherein said desiccant is silica gel granules.

10. The invention as defined in claim 8 wherein said desiccant is silica gel granules.

11. The invention as defined in claim 9 wherein said silica gel granules are in the size range of 8 to 60 mesh.

12. The invention as defined in claim 10 wherein said silica gel granules are in the size range of 8 to 60 mesh.

13. The invention as defined in claim 1 including a cover disposed over the outer surface of the body, said cover being permeable to water vapor and having a thermal conductivity greater than that of the body.

14. The invention as defined in claim 13 wherein the cover comprises a porous sheet having a thermal conductivity in the range of 1.5 to 2.0 BTU-in/ft$^2$hr°F. at 260° F. and a water vapor permeability in the range of 1.0 to 1.5 darcies at 260° F.

15. The invention as defined in claim 13 wherein said cover comprises a porous sheet having a thermal conductivity in the range of 0.5 to 0.7 BTU-in/ft$^2$hr°F. at 260° F. and a water vapor permeability in the range of 6.5 to 7.5 darcies at 260° F.

16. The invention as defined in claim 1 wherein said device also comprises a roller cap adapted to be disposed over at least a part of said body with hair disposed between the body and the cap, said cap being pervious to water vapor and being a good thermal insulator.

17. The invention as defined in claim 16 wherein said cap is a semicylindrical body of polymeric open-cell foam.

18. The invention as defined in claim 17 wherein said semicylindrical body is a polyester open-cell foam with end covers and substantially coextensive with the first mentioned body.

19. The invention as defined in claim 16 wherein said cap comprises a semicylindrical body having an inner layer of hydrophobic polyester open-cell foam and an outer layer of hydrophilic polyester open-cell foam.

20. The invention as defined in claim 19 wherein said inner layer is approximately ⅛ to ¼ inch thick and said outer layer is approximately ⅛ to ¼ inch thick, said inner layer being more porous than said outer layer.

21. The method of curling dry hair comprising the steps of heating a roller above ambient temperature, said roller comprising a body of desiccant, adding a controlled amount of moisture to the hair roller, so that at least some moisture is adsorbed by the desiccant, rolling the dry hair around said roller, while the roller is still above ambient temperature and still contains moisture, maintaining the hair on the roller until some moisture has been taken by the hair from the desiccant and the hair has taken a set in the rolled condition, and removing the roller from the hair.

22. The invention as defined in claim 21 wherein said steps of heating the hair roller and adding a controlled amount of moisture are performed simultaneously.

23. The invention as defined in claim 21 wherein said step of heating includes raising the temperature of said hair roller to about 200° F.

* * * * *